US007198419B2

(12) United States Patent
Lee

(10) Patent No.: US 7,198,419 B2
(45) Date of Patent: Apr. 3, 2007

(54) APPARATUS AND METHOD OF PERFORMING DOUBLE-SIDED PRINTING

(75) Inventor: Yong-duk Lee, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 196 days.

(21) Appl. No.: 10/950,604

(22) Filed: Sep. 28, 2004

(65) Prior Publication Data

US 2005/0078996 A1 Apr. 14, 2005

(30) Foreign Application Priority Data

Oct. 8, 2003 (KR) ..... 10-2003-0070071
Aug. 26, 2004 (KR) ..... 10-2004-0067438

(51) Int. Cl.
*B41J 3/60* (2006.01)
*B41J 2/32* (2006.01)
*B41J 25/304* (2006.01)

(52) U.S. Cl. ..... 400/120.16; 400/120.17; 400/188

(58) Field of Classification Search ..... 400/188
See application file for complete search history.

(56) References Cited

U.S. PATENT DOCUMENTS 5,708,954 A * 1/1998 Ando et al. ..... 399/402
5,746,526 A * 5/1998 Hirose ..... 400/619
5,956,068 A 9/1999 Odai et al. ..... 347/218
6,296,405 B1 * 10/2001 Brewington et al. ..... 400/188
6,450,714 B2 9/2002 Mori et al. ..... 400/649
6,601,952 B2 * 8/2003 Sugioka et al. ..... 347/104
6,634,815 B2 * 10/2003 Burikov et al. ..... 400/354

FOREIGN PATENT DOCUMENTS

| | | | |
|---|---|---|---|
| JP | 61-211062 | | 9/1986 |
| JP | 64-087282 | | 3/1989 |
| JP | 64-087376 | | 3/1989 |
| JP | 04310770 | A * | 11/1992 |
| JP | 05-220989 | | 8/1993 |
| JP | 05238073 | A * | 9/1993 |
| JP | 05-301412 | | 11/1993 |
| JP | 09-226161 | | 9/1997 |
| JP | 09-254486 | | 9/1997 |
| JP | 10-217516 | | 8/1998 |
| JP | 2001-310503 | | 11/2001 |
| JP | 2002-051196 | | 2/2002 |
| JP | 2006051735 | A * | 2/2006 |
| KR | 1985-001862 | | 4/1985 |
| KR | 1998-015628 | | 5/1998 |
| KR | 1998-055553 | | 9/1998 |
| KR | 1999-0035901 | | 5/1999 |
| KR | 2000-0047112 | | 7/2000 |

* cited by examiner

*Primary Examiner*—Daniel J. Colilla
(74) *Attorney, Agent, or Firm*—Roylance, Abrams, Berdo & Goodman, LLP

(57) ABSTRACT

A method and an apparatus for forming an image on a medium having first and second surfaces wherein an image is formed on the first surface of the medium using a printing unit. After the image formation on the first surface of the medium is completed, the medium is returned to the printing start location, and a location change unit is used to move the printing unit from a first position to a second position facing a second surface of the medium, then an image is formed on the second surface of the medium using the printing unit.

24 Claims, 15 Drawing Sheets

APPARATUS AND METHOD OF PERFORMING DOUBLE-SIDED PRINTING

CROSS-REFERENCE TO RELATED APPLICATIONS

This application claims the benefit under 35 U.S.C. §119 (a) of Korean Patent Application Nos. 2003-70071 and 2004-67438, filed in the Korean Intellectual Property Office on Oct. 8, 2003, and on Aug. 26, 2004, respectively, the entire contents of each of which are incorporated herein by reference.

BACKGROUND OF THE INVENTION

1. Field of the Invention

The present invention relates to an apparatus and method of printing images on both surfaces of a medium (such as paper). More particularly, the present invention relates to an apparatus and method for forming an image on a medium using a location change unit for locating a printing unit at any of first and second positions facing a first and second surface, respectively, of the medium.

2. Description of the Related Art

In a conventional method of forming an image using thermal transfer, a ribbon film is closely attached to media (such as paper) using a predetermined pressure, and ink coated on the ribbon film is heated using a thermal printing head (TPH), sublimated, and transferred toward the media. An example of a printer based on thermal transfer includes a printer disclosed in U.S. Patent Publication No. 20030071887, issued to Toshiyuki Yamamoto, the entire content of which is incorporated herein by reference.

A general ink ribbon as described above typically has a cassette shape. The cassette-shaped ink ribbon includes a feeding core around which a ribbon is wound, a winding core which winds the ribbon off the feeding core, and a housing which supports the feeding core and the winding core.

In an image forming apparatus using such an ink ribbon, for example, a color thermal transfer printer, the ink ribbon has a structure in which an arrangement of cyan (C), yellow (Y), magenta (M), and black (K) areas are repeated. Upon color image formation using this ink ribbon, each of the color areas of the ink ribbon should face a medium, and at least four coatings should be performed. To perform these coatings, sublimation and transfer of ink should occur while the medium is reciprocating four times.

As described above, in a conventional method of forming a color image, it takes a significant period of time to form an image, and requires a cassette for housing an ink ribbon. Since the media and the cassette are both consumption goods, they are economically burdensome to users. A mechanism for transferring and driving the media and the ink ribbon is also needed. Thus, an image forming apparatus becomes complicated and expensive.

Accordingly, a need exists for a printing unit which is capable of forming an image on a medium having first and second surfaces, with greater speed and requiring a simpler apparatus.

SUMMARY OF THE INVENTION

The present invention provides an image forming method by which an image forming speed is greatly improved, and a simple apparatus for performing the image forming method.

The present invention also provides an image forming method by which an image forming apparatus becomes cost-efficient and structurally stable due to the simplification of the image forming mechanism, and an apparatus performing the image forming method.

According to an object of the present invention, an image forming apparatus is provided including a printing unit for forming an image on a medium having first and second surfaces on each of which an image can be printed, and a location change unit for locating the printing unit at any of first and second positions facing the first and second surfaces, respectively, of the medium.

The printing unit includes a thermal printing head and a platen roller which faces the thermal printing head and supports the medium. The location change unit rotates the printing unit about a contact portion between the thermal printing head and the platen roller to locate the thermal printing head at one of the first and second positions.

The location change unit includes rotating plates which support both ends of each of the thermal printing head and the platen roller, and which are installed rotatably about the contact portion between the thermal printing head and the platen roller, and further includes a rotating cam which rotates the rotating plates so that the thermal printing head can face any of the first and second surfaces of the medium. The location change unit further includes a shaft having one end connected to the thermal printing head and the other end inserted into a through hole formed on the rotating plate. The rotating cam pushes the shaft to rotate the rotating plates.

The image forming apparatus further includes a locking unit for locking the thermal printing head at the first and second positions. The locking unit includes first and second engagement grooves formed in the rotating plate and facing the first and second positions of the thermal printing head, a locking member engagable with the first and second engagement grooves, and an elastic member for elastically biasing the locking member in such a direction to lock the locking member into one of the first and second engagement grooves. The rotating cam releases the locking member from one of the first and second engagement grooves to rotate each of the rotating plates. The rotating plate has a circular circumference, and the first and second engagement grooves are formed on the circular circumference. The locking member continuously contacts the circular circumference of the rotating plate while the rotating cam is rotating the rotating plates. The locking member is locked into one of the first and second engagement grooves by an elastic force of the elastic member when the thermal printing head is located at one of the first or second positions.

The image forming apparatus further includes an elastic member for elastically biasing the thermal printing head in such a direction that the thermal printing head contacts the rotating plates, first and second engagement grooves formed in the rotating plate and facing the first and second positions, respectively, of the thermal printing head, a locking member engagable with the first and second engagement grooves, and an elastic member for elastically biasing the locking member in such a direction that the locking member is locked into one of the first and second engagement grooves.

The thermal printing head is combined with the rotating plates such as to be rotated in such a direction that the thermal printing head is moved to or from the platen roller. The through hole has a shape of a circular arc formed based on a rotating axis of the thermal printing head. When the locking member is locked into one of the first and second engagement grooves, the rotating cam comes into contact with the shaft such that the thermal printing head is moved to or from the platen roller. When the locking member is released from one of the first and second engagement grooves, the rotating cam pushes the shaft to rotate each of the rotating plates.

According to another object of the present invention, an image forming method is provided including steps for transferring a medium having first and second surfaces on each of which an image can be printed to a printing start location, forming an image on the first surface using a printing unit while transferring the medium at a predetermined printing speed, returning the medium to the printing start location after the image formation on the first surface is completed, and then forming an image on the second surface using the printing unit while re-transferring the medium at the predetermined printing speed.

In the formation of the image on the second surface, the printing unit is rotated so as to face the second surface.

The printing unit includes a thermal printing head and a platen roller which faces the thermal printing head to support the medium. During the transferring of the medium to the printing start location and the returning of the medium to the printing start location, the thermal printing head and the platen roller are separated from each other, and the printing unit is rotated about the contact portion between the thermal printing head and the platen roller.

BRIEF DESCRIPTION OF THE DRAWINGS

The above and other objects, features and advantages of the present invention will become more apparent by describing in detail exemplary embodiments thereof with reference to the attached drawings in which.

Throughout the drawings, like reference numerals will be understood to refer to like parts, components and structures.

DETAILED DESCRIPTION OF THE EXEMPLARY EMBODIMENTS

Figure 8:
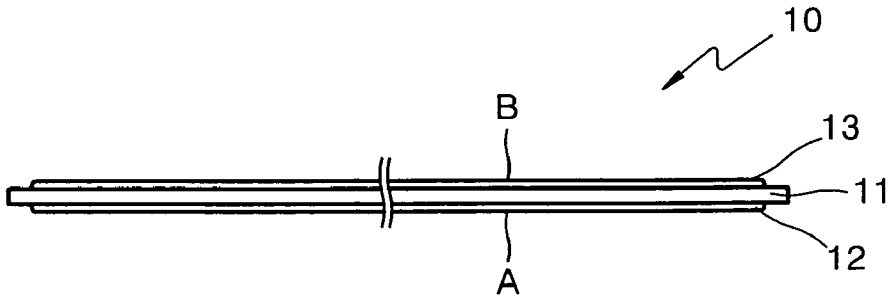
FIG. 8 is a cross-sectional view of a medium used in a method and apparatus for forming an image according to embodiments of the present invention.

Media used in a method and apparatus for forming an image according to an embodiment of the present invention will now be described with reference to FIG. 8. Referring to FIG. 8, a medium 10 is produced by forming ink layers 12 and 13 with predetermined colors on both surfaces of a base sheet 11, which are first and second surfaces A and B of medium 10. Each of the ink layers 12 and 13 may include a single layer for representing a single color, or multiple layers for representing 2 or more colors. For example, the ink layer 12 on the first surface (i.e., surface A) of the base sheet 11 may be formed of two layers to express yellow (Y) and magenta (M) colors, and the ink layer 13 on the second surface (i.e., surface B) thereof may be formed of a single layer to express a cyan (C) color. The medium 10 of FIG. 8 is just one example of the possible combinations, and the structures of the ink layers 12 and 13 on the first and second surfaces A and B shown in FIG. 8 are not intended to restrict the scope of the present invention.

When such a medium as shown in FIG. 8 is used, a corresponding printing unit is provided which includes a thermal printing head (TPH). When a general medium having no ink layers is used, an ink-jet print head, a laser printer, and the like, may be used as the printing unit. Therefore, a suitable medium is preferably selected depending on the type of the above-described printing unit.

Figure 1:
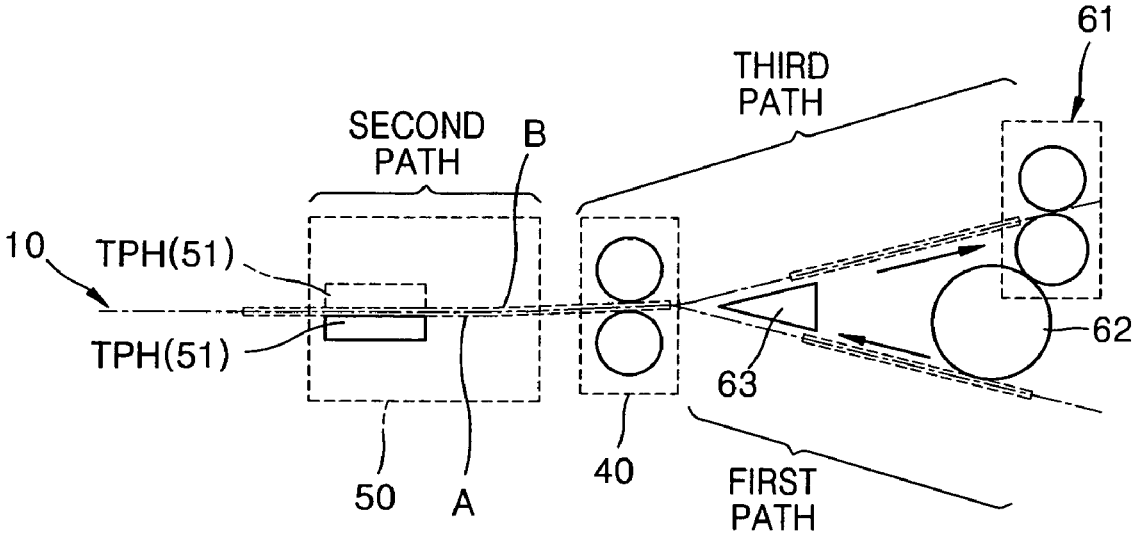
FIG. 1 is a diagram for illustrating an example of an image forming method according to an embodiment of the present invention.

FIG. 1 illustrates an image forming method according to an embodiment of the present invention. As illustrated in FIG. 1, the medium 10 is transferred along first, second, and third paths. That is, the medium 10 is transferred along a rectilinear path instead of a circular path along which the medium 10 can repetitively circulate to be multi-coated with ink. To form an image on the second surface B of the medium 10 after forming an image on the first surface A at a printing location, the medium 10 is returned to the printing location along a rectilinear path that the medium 10 has already passed to form an image on the first surface A, instead of along a circular path. Thereafter, the image is printed on the second surface B of the medium 10 that is advancing, and the medium 10 on which the image has been printed is discharged in the same direction as the direction from where the medium 10 was advanced.

In FIG. 1, a first path illustrates a path along which the medium 10 is supplied. A second path illustrates a path where the medium 10 waits for printing and printing occurs. A third path separates from a connection point between the first and second paths. The third path illustrates a path where the medium 10, on which only the first surface A has been printed with an image, stays temporarily, and along which the medium 10, once both the first and second surfaces A and B have been printed, is subsequently discharged.

A media guide 63, for guiding the medium 10 supplied along the first path to the second path, and for guiding the medium 10 on which printing has been completed from the second path to the third path, is installed at the connection between the first and second paths. The structure of the media guide 63 is well known to those skilled in the art and as such, will not be described in greater detail here.

A printing unit 50, for printing an image on the medium 10, is installed on the second path. A transfer unit 40 is installed between the first path and the printing unit 50. Image formation, as described in greater detail below, occurs twice. However, as necessary, the image formation may occur more than twice. In this embodiment example, a total of two image formations occur on the first and second surfaces A and B of the medium 10.

The printing unit 50 includes a thermal printing head (TPH) 51. Before forming an image on the first and second surfaces A and B of the medium 10, the TPH 51 must be located at a predetermined position. For example, when an image is to be formed on the first surface A of the medium 10, the TPH 51 must face the first surface A. When an image is to be formed on the second surface B of the medium 10, the TPH 51 must face the second surface B. To avoid collision with the medium 10, a position change of the TPH 51 occurs before the medium 10 is supplied along the first path, or while the medium 10 is temporarily staying on the third path after an image is formed on the first surface A.

Figure 2A:
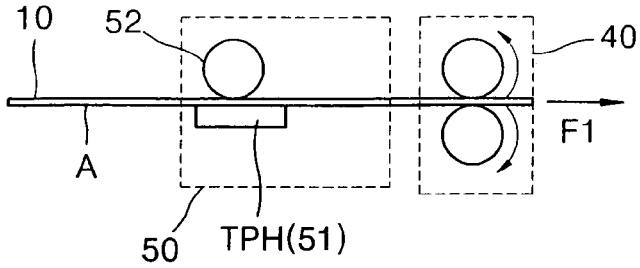
FIGS. 2A through 2D illustrate steps of the image forming method of FIG. 1.

A method of forming an image on the medium 10 with the above exemplary embodiment will now be described step by step with reference to FIGS. 1 and 2A through 2D. The medium 10, supplied along the first path using a pickup roller 62, is guided to the second path by the media guide 63. As shown in FIG. 2A, the medium 10 is transferred up to a location where printing starts. Thereafter, the medium 10 is transferred in direction F1 at a predetermined printing speed by the transfer unit 40. The TPH 51 is located at a first position facing the first surface A of the medium 10, and a platen roller 52 faces the TPH 51 to support the medium 10. During image formation, the medium 10 is gradually transferred by the transfer unit 40. The medium 10 is guided to the third path by the media guide 63. A discharge unit 61 then temporarily discharges the medium 10.

Figure 2B:
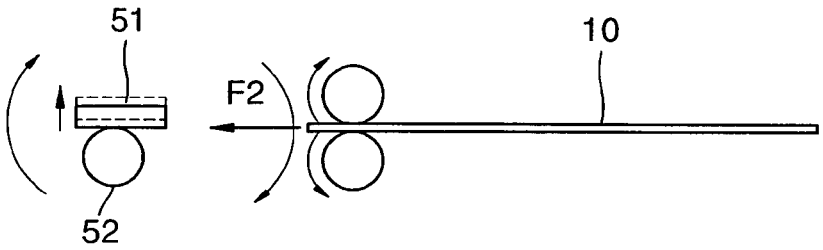
Figure 2C:
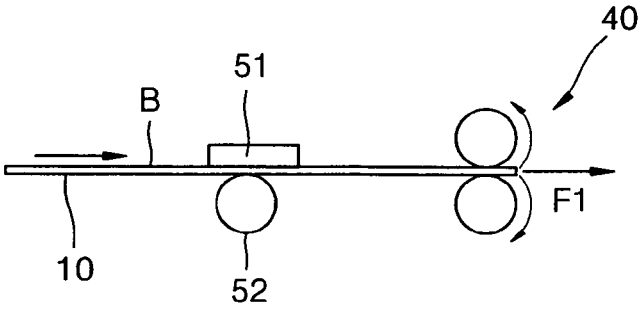

When image formation on the first surface A is completed, the printing unit 50 is rotated while the medium 10 pauses on the third path, so that the locations of the TPH 51 and the platen roller 52 are switched with each other. Next, as illustrated in FIG. 2B, the medium 10 is transferred in direction F2 and re-enters the second path. The medium 10 reaches the location where printing starts as illustrated in FIG. 2C. While the medium 10 is returning to the second path, the TPH 51 and the platen roller 52 may be separated from each other as shown in FIG. 2B.

As illustrated in FIG. 2C, the TPH 51 is now located at a second position facing the second surface B of the medium 10. The platen roller 52 supports the medium 10. The transfer unit 40 transfers the medium 10 back in the direction F1 at the predetermined printing speed. At this time, the TPH 51 applies heat to the second surface B of the medium 10 to form an image on the second surface B.

Figure 2D:
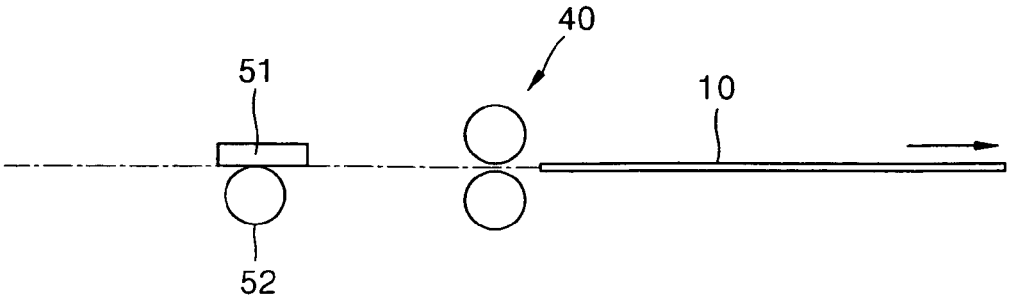

As illustrated in FIG. 2D, the medium 10, on which both the first and second surfaces A and B have been completely printed with images, is discharged along the third path using the discharge unit 61.

The present invention will be understood more clearly through the below description of a structure and an operation of an image forming apparatus according to an exemplary embodiment of the present invention.

Figure 3:
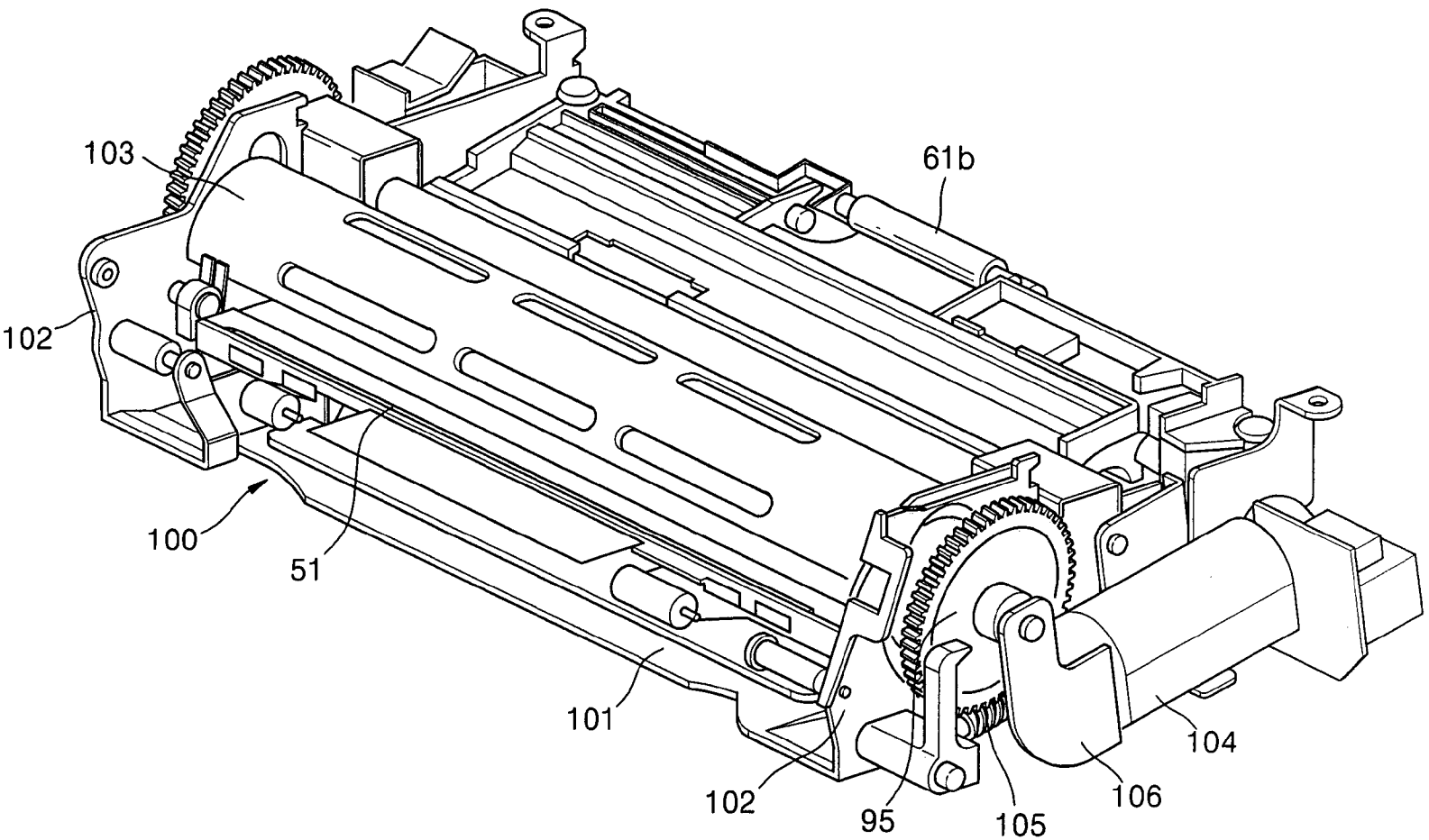
FIG. 3 is a perspective view of an image forming apparatus according to an embodiment of the present invention.
Figure 4:
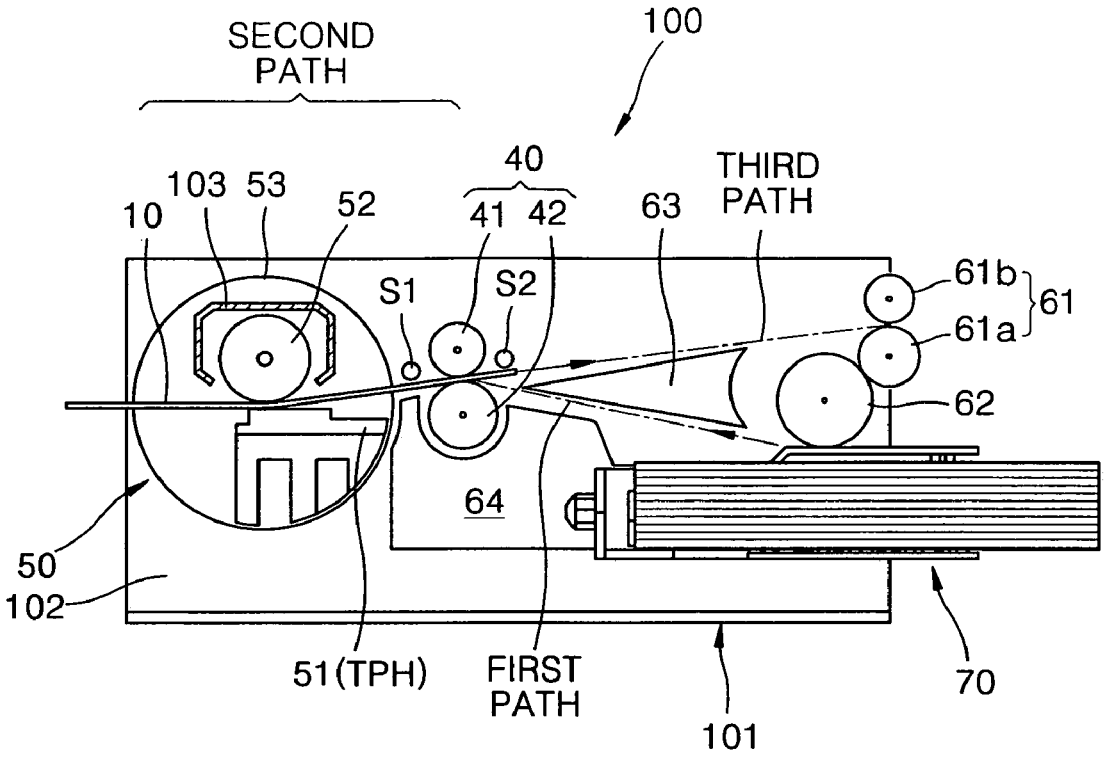
FIG. 4 is a cross-sectional view of the image forming apparatus of FIG. 3.

FIG. 3 is a perspective view of an image forming apparatus according to an embodiment of the present invention. FIG. 4 is a cross-sectional view of an interior of the image forming apparatus of FIG. 3.

As illustrated in FIGS. 3 and 4, a frame 100, provided for substantially supporting the entire structure of the image forming apparatus, includes a bottom base 101, and two lateral plates 102 extending up from both lateral sides of the bottom base 101. A feeding cassette 70, in which a medium is contained, is installed on a side of the frame 100.

The pickup roller 62, provided for picking up the media contained in the feeding cassette 70, is installed over the feeding cassette 70. The discharge unit 61, provided for discharging the printing-completed medium 10, includes a discharge roller 61*a*, which contacts the pickup roller 62 and is thus dependently driven by the pickup roller 62, and an idle roller 61*b*, which contacts the discharge roller 61*a* and is thus dependently driven by the discharge roller 61*a*. The medium 10 is transferred between the discharge roller 61*a* and the idle roller 61*b* and discharged. This structure facilitates simplification of a power connection structure to transfer the medium 10.

The printing unit 50 is installed at a side opposite to a side where the pickup roller 62 and the discharge unit 61 are installed. The printing unit 50 includes the TPH 51 and the platen roller 52 (refer to FIG. 4), which faces the TPH 51 and supports the medium 10. The transfer unit 40 is installed between the printing unit 50 and the pickup roller 62 to transfer the medium 10. The transfer unit 40 includes a driving roller 42 and an idle roller 41, which engages with the driving roller 42 to squeeze the medium 10.

In the example shown in FIGS. 3 and 4, the first path is defined between the pickup roller 62 and the transfer unit 40, the second path is defined where the printing unit 50 is installed, and the third path is defined between the transfer unit 40 and the discharge unit 61. The first, second, and third paths form a "y-shaped" character. The media guide 63 is a wedge for guiding the medium 10 picked up from the feeding cassette 70 to the second path, where the printing unit 50 is located, via the transfer unit 40, and for then guiding the media 10 from the second path to the third path. A bottom media guide 64 and the media guide 63 form the first path.

Although not shown in detail in the drawings, all moving elements including the transfer unit 40, the discharge unit 61, and the pickup roller 62, can rotate in forward and reverse directions. Hence, the medium 10 can be transferred from the first path to the second path, from the second path to the third path, and from the third path to the second path.

A power transmit structure can be designed to provide the required forward and reverse rotations for the image forming methods and apparatuses according to embodiments of the present invention noted above. At least one stepping motor, DC motor, or other controllable motor may be used as a power source of the power transmit structure. Such a design and selection of the power transmit structure can be easily made by those skilled in the art to which the present invention belongs, and thus does not limit the technical scope of the present invention. Using such a power source, the transfer unit 40 is then capable of driving the medium 10 until the medium 10, withdrawn from the feeding cassette 70, is finally discharged.

The image forming apparatus in the exemplary embodiment further includes first and second sensors S1 and S2, for detecting the medium 10.

The first and second sensors S1 and S2 are disposed at both sides of the transfer unit 40, respectively. The first sensor S1, disposed closer to the printing unit 50, senses one end (for example, a front end) of the medium 10, and the second sensor S2 senses the other end (for example, a rear end) of the medium 10. The first and second sensors S1 and S2 are used to determine a number of issues, such as detecting the existence or non-existence of the medium 10, or to determine a location where printing on the medium 10 on the second path starts, and to further detect the return of the medium 10 from the third path back to the second path, or to achieve any number of other purposes.

Figure 5:
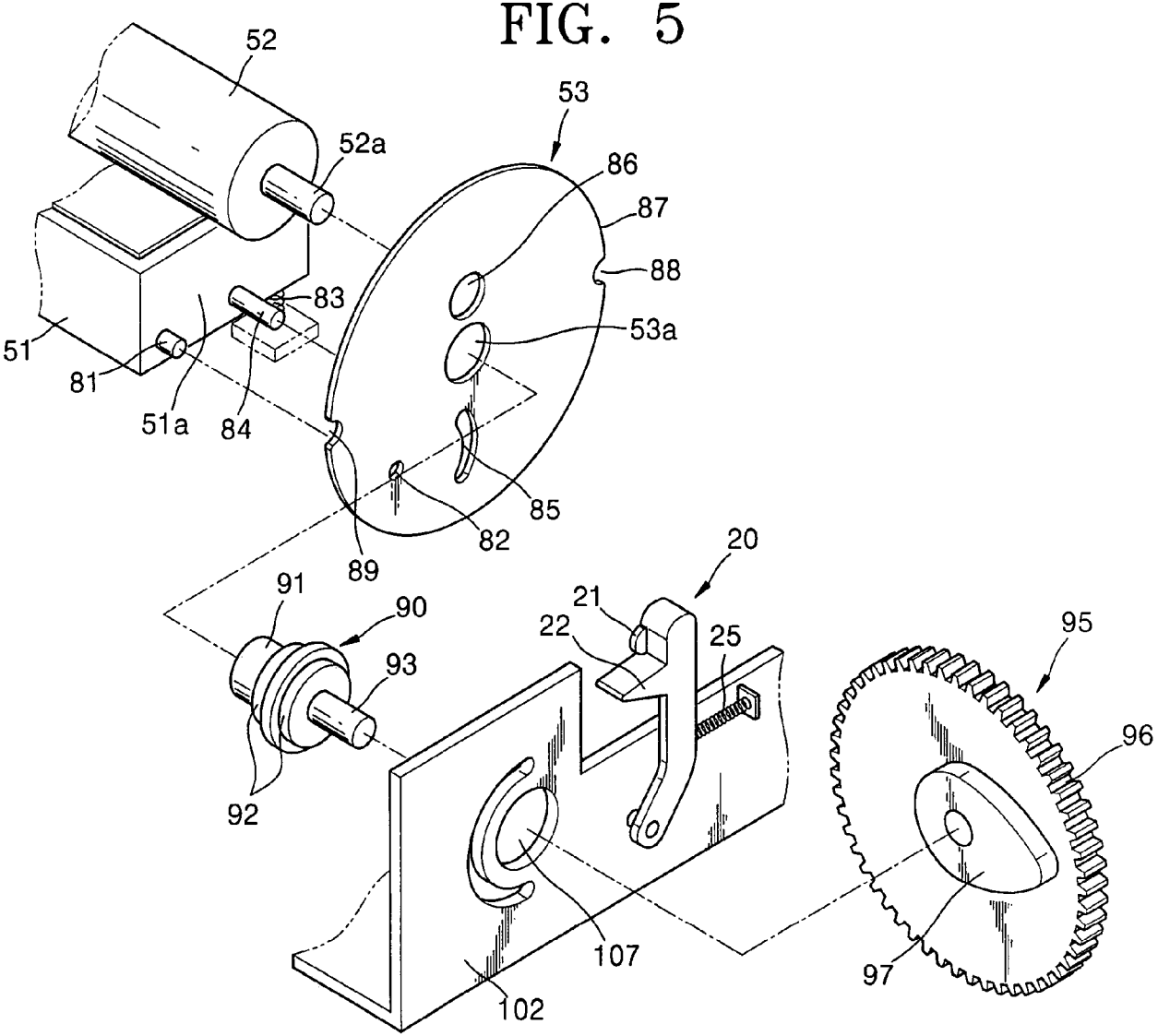
FIG. 5 is an exploded perspective view of a location change unit shown in FIG. 3, according to an embodiment of the present invention.

A feature of the image forming apparatus according to the exemplary embodiment is that the image forming apparatus includes a location change unit for changing a location of the printing unit 50 to either the first or second positions facing the first or second surface A or B, respectively, of the medium 10. The location change unit includes a pair of rotating plates 53, rotatably supported by the lateral plates 102, and a rotating cam 95 for rotating the rotating plates 53 as shown in FIG. 5. Both ends of each of the TPH 51 and the platen roller 52 are supported by the rotating plates 53. The rotating plates 53 are installed to be rotatable about an axis in alignment with a contact portion between the TPH 51 and the platen roller 52. The contact portion is preferably a heating line of the TPH 51 that substantially heats the medium 10. The TPH 51 is coupled to the rotating plates 53 to provide a degree of movement between the TPH 51 and the platen roller 52 as shown in FIG. 2B. Thus, an appropriate pressure can be applied to the medium 10. Also, when the medium 10 enters the second path from the first or third path, the TPH 51 is separated from the platen roller 52 so as not to obstruct the travel of the medium 10.

FIG. 5 is an exploded perspective view of the location change unit. Referring to FIG. 5, a hinge shaft 81 formed on a lateral portion 51*a* of the TPH 51 is inserted into a hinge hole 82 formed in each of the rotating plates 53 (only one of plates 53 shown in FIG. 5), so that the TPH 51 is combined with the rotating plate 53 to be rotatable about the hinge shaft 81. The TPH 51 is elastically biased by a first elastic member 83 in such a direction to contact the platen roller 52. Although not shown in FIG. 5, the first elastic member 83 may be a tensile coil spring having one end connected to the TPH 51, and the other end connected to a cover 103 of FIGS. 3 and 4, which covers the platen roller 52. The cover 103 is coupled to the rotating plates 53.

One end of a shaft 84 is also formed on the lateral portion 51*a* of the TPH 51, and the other end thereof is inserted into a through hole 85 formed in each of the rotating plates 53. The through hole 85 is preferably in the shape of a slot along which the TPH 51 can move to and from the platen roller 52. In the exemplary embodiment, the TPH 51 rotates about the hinge hole 82 to be moved to and from the platen roller 52. Hence, the through hole 85 is preferably in the shape of a circular arc formed around the hinge hole 82.

The platen roller 52 is not connected to a driving motor (not shown). The platen roller 52 is dependently rotated in contact with the medium 10 that is transferred by the transfer unit 40. A shaft 52*a* of the platen roller 52 is inserted into a through hole 86 of each of the rotating plates 53 so that the platen roller 52 is rotatably supported by the rotating plates 53. Each of the rotating plates 53 has a support hole 53*a*, whose center is aligned with the contact portion between the TPH 51 and the platen roller 52.

A bushing 90 includes first, second, and third outer circumferential portions 91, 92, and 93, respectively, which are each concentric. The second outer circumferential portion 92 is inserted into a hole 107 formed in each of the lateral sides 102 so that a bushing 90 is combined with each of the lateral sides 102. The support hole 53*a* is inserted onto the first outer circumferential portion 91 so that each of the rotating plates 53 is rotatably combined with a bushing 90. The rotating cam 95 is rotatably combined with the third outer circumferential portion 93.

The rotating cam 95 includes a gear portion 96 and a cam portion 97 for contacting the shaft 84. Referring to FIGS. 3 and 5, a motor 104 has a worm gear 105 which engages with the gear portion 96. A bracket 106, to which the motor 104 is coupled, is combined with the lateral side 102. The end of the third outer circumferential portion 93 of bushing 90 is supported by the bracket 106. The bracket 106 prevents the rotating cam 95 from being detached from the third outer circumferential portion 93 at lateral side 102. According to this structure, each of the rotating plates 53 is rotated by the rotating cam 95 so that the TPH 51 and the platen roller 52 are rotated about the support hole 53*a*. Thus, the TPH 51 can be located at the first and second positions (shown in FIGS. 2A and 2C, respectively) facing the first and second surfaces A and B, respectively, of the medium 10.

The rotating plate 53 has a circular circumference 87, in which first and second engagement grooves 88 and 89 are formed and separated from each other by 180 degrees. A locking member 20 is rotatably combined with the lateral side 102. A second elastic member 25 applies an elastic force to the locking member 20 in such a direction that the locking member 20 can be engaged with the first or second engagement grooves 88 and 89. The locking member 20 is released from the first and second engagement grooves 88 and 89 by the rotating cam 95, and engaged with the first or second engagement grooves 88 and 89 by the elastic force of the second elastic member 25. The locking member 20 includes a protrusion 21, which is inserted into the first or second engagement grooves 88 and 89, and an interfering portion 22, which interferes with the cam portion 97 of the rotating cam 95.

FIGS. 6A through 6I illustrate exemplary operations of the location change unit shown in FIG. 5. FIGS. 7A through 7I illustrate an exemplary operation of the image forming apparatus of FIG. 3, in which images are printed on both surfaces of the medium 10 to represent a single image.

Figure 6A:
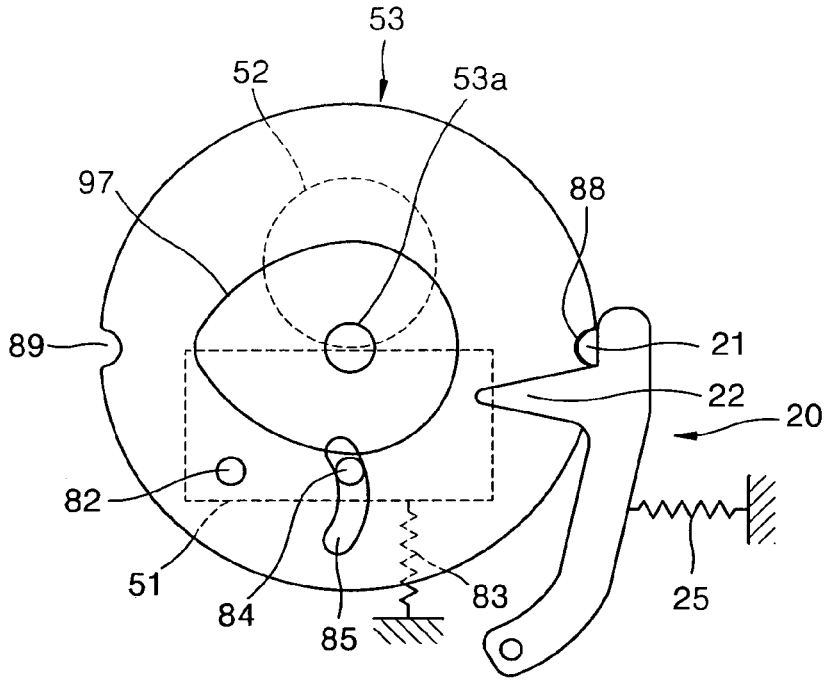
FIGS. 6A through 6I illustrate operations of the location change unit of FIG. 5.
Figure 7A:
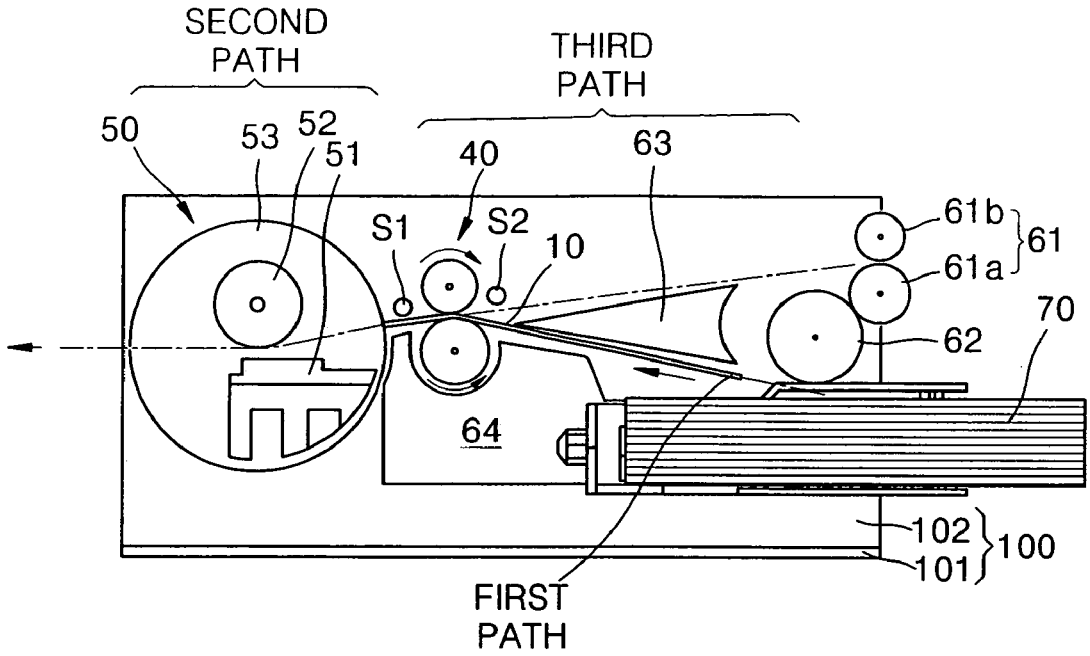
FIGS. 7A through 7I illustrate a printing operation of the image forming apparatus of FIG. 3, according to an embodiment of the present invention.

As shown in FIG. 7A, the TPH 51 is located at the first position facing the first surface A of the medium 10. As shown in FIG. 6A, the TPH 51 is pressed down on the platen roller 52. The protrusion 21 of the locking member 20 is engaged with the first engagement groove 88, such that the TPH 51 is locked at the first position. The medium 10, withdrawn from the feeding cassette 70 by the pickup roller 62, is transferred to the transfer unit 40 along the first path. As shown in FIG. 7A, the TPH 51 is preferably detached from the platen roller 52 before the withdrawn medium 10 is transferred to the second path or before the medium 10 is picked up by the pickup roller 62.

Figure 6B:
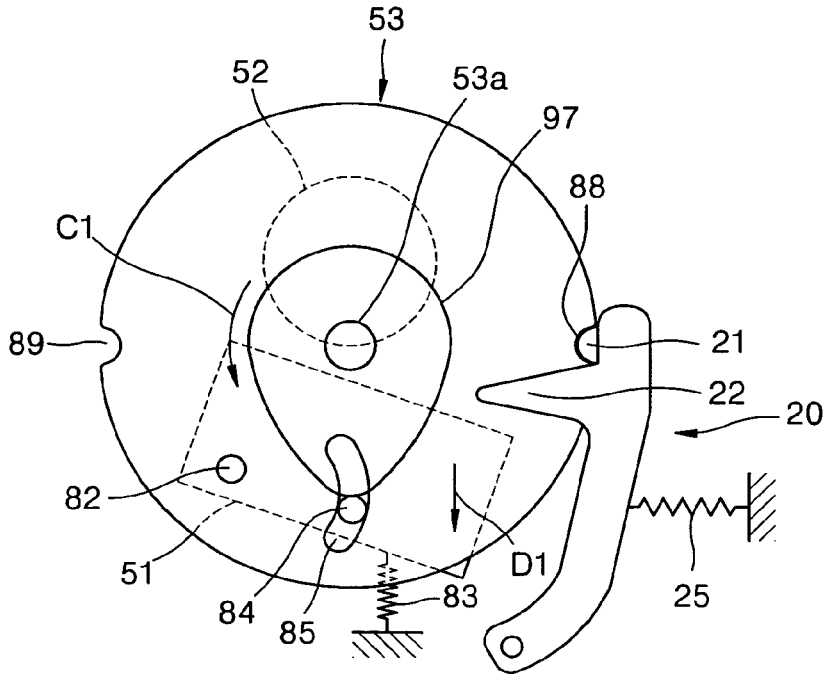

Referring to FIG. 6B, as the rotating cam 95 is rotated in direction C1, the cam portion 97 pushes the shaft 84 in direction D1. Because the protrusion 21 of the locking member 20 is engaged with the first engagement groove 88, each of the rotating plates 53 is not rotated. As the shaft 84 is pushed in direction D1 along the through hole 85, the TPH 51 is rotated about the hinge hole 82 and moved from the platen roller 52. At this time, the transfer unit 40 transfers the medium 10 to the second path. Then, since the TPH 51 and the platen roller 52 are separated from each other, the medium 10 can be interposed between the TPH 51 and the platen roller 52 without resistance although the platen roller 52 is not rotated.

Figure 6C:
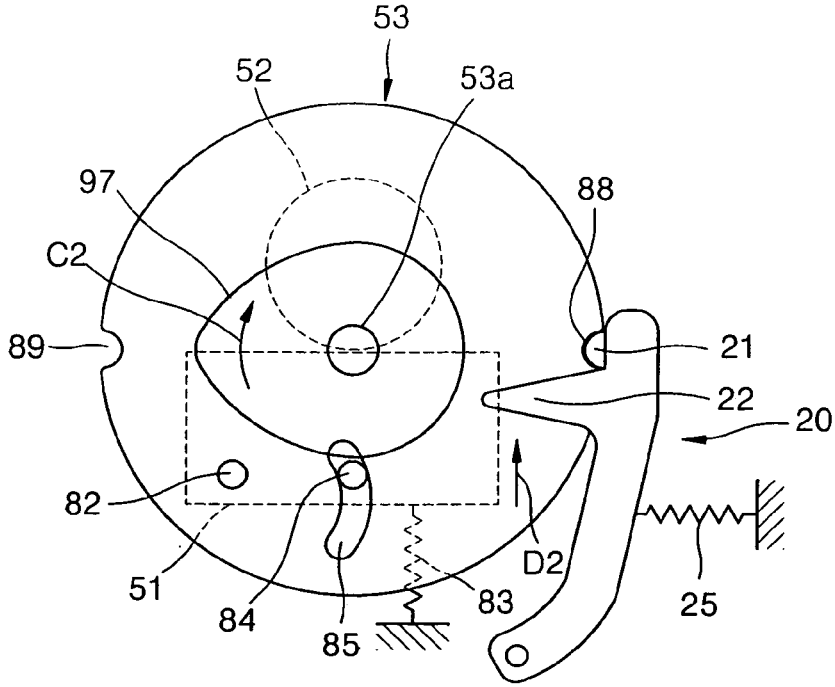
Figure 7B:
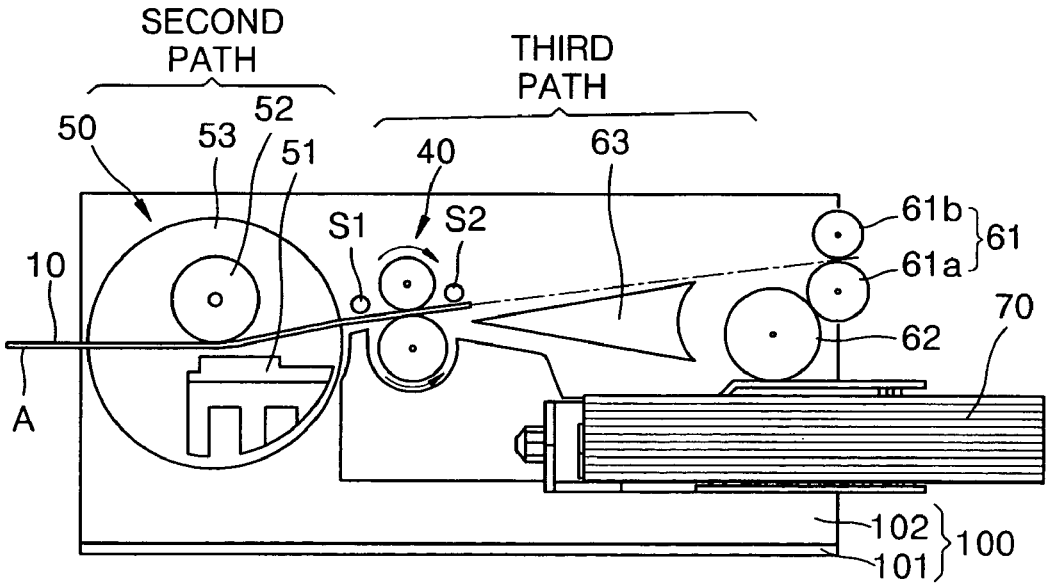
Figure 7C:
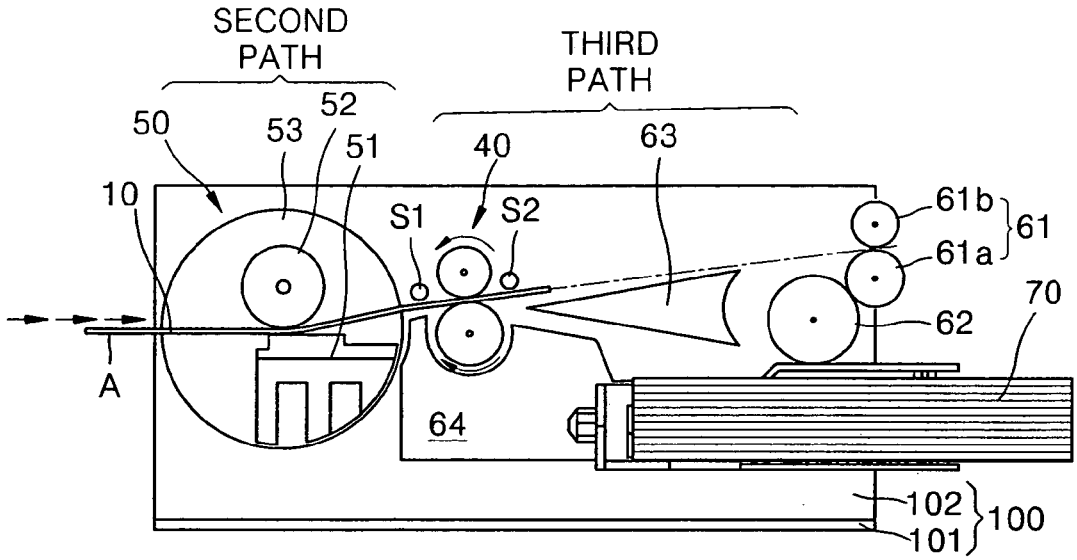

As shown in FIG. 7B, when the medium 10 is transferred to the printing start location, the transfer unit 40 stops transferring the medium 10. Referring to FIG. 6C, the rotating cam 95 is rotated in direction C2. The protrusion 21 of the locking member 20 is still engaged with the first engagement groove 88, so each of the rotating plates 53 is not rotated. The TPH 51 is rotated about the hinge hole 82 in direction D2 by an elastic force of the first elastic member 83. Then, as shown in FIG. 7C, the first surface A of the medium 10 faces the TPH 51 and is elastically supported by the platen roller 52.

Figure 7D:
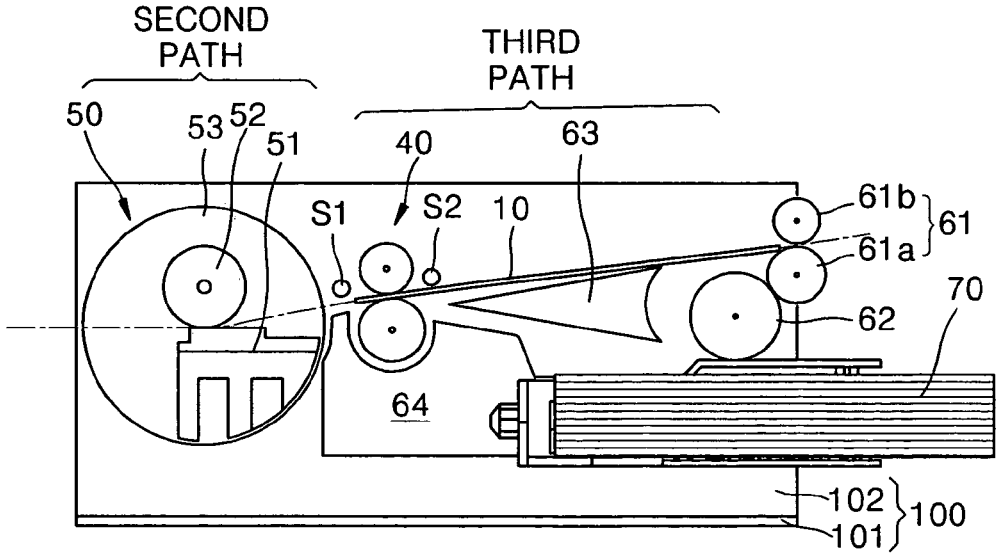

At this time, the transfer unit 40 starts transferring the medium 10 toward the third path. The TPH 51 heats the first surface A of the medium 10 to print, for example, an image with magenta (M) and yellow (Y) colors on the first surface A. The M and Y colors are selectively presented depending on a temperature of the TPH 51 and a duration of heating by the TPH 51. For example, the M color is presented by heating the first surface A at a high temperature for a short period of time, and the Y color is presented by heating the first surface A at a low temperature for a long period of time. As shown in FIG. 7D, when the image printing on the first surface A of the medium 10 is completed, the medium 10 departs the second path and is transferred and pauses on the third path, wherein the transfer unit 40 stops transferring the medium 10.

Figure 6D:
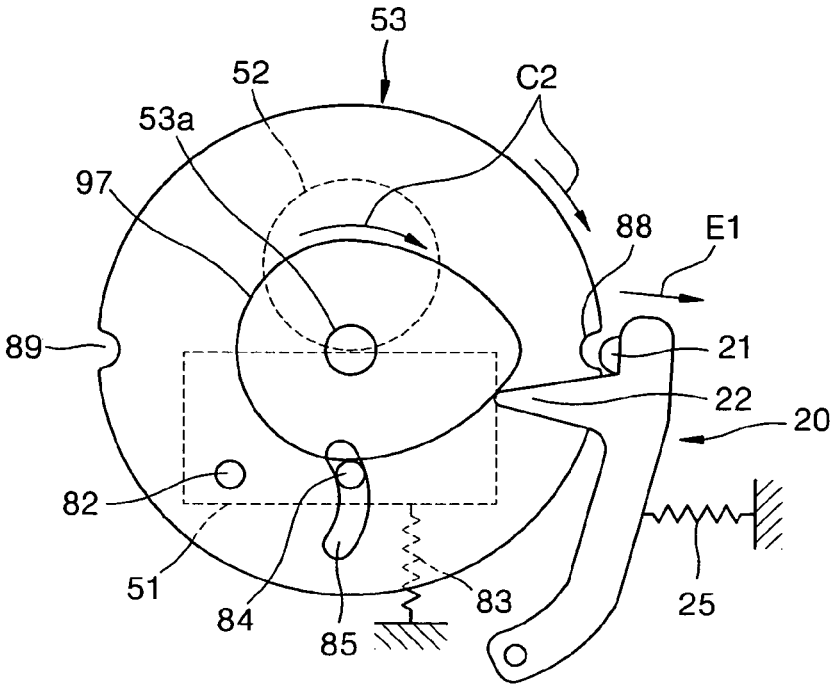
Figure 6E:
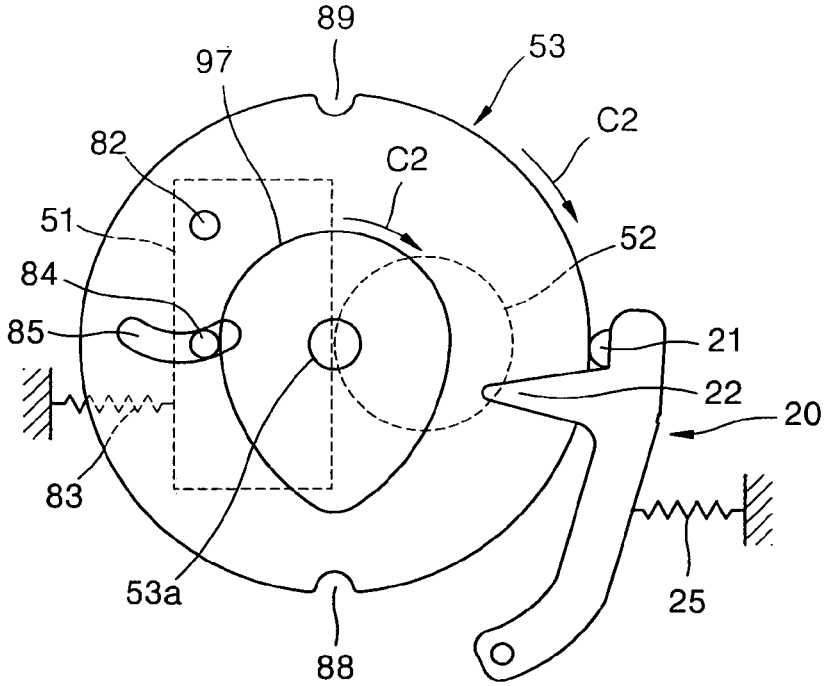
Figure 7E:
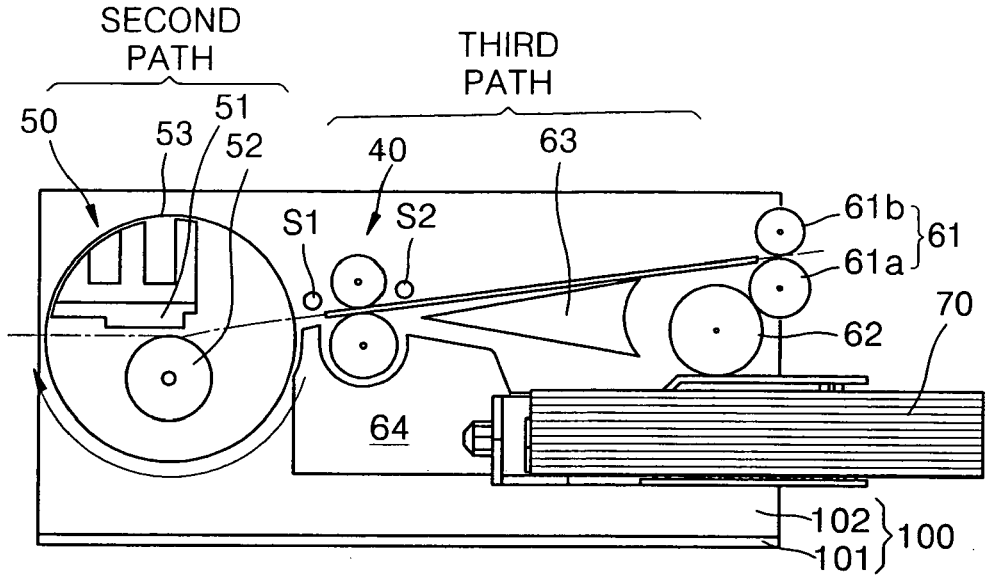

As shown in FIG. 7E, to print an image on the second surface B of the medium 10, the transfer of the medium 10 back to the second path position is performed. Referring to FIG. 6D, when the rotating cam 95 is rotated in direction C2, the cam portion 97 pushes the interfering portion 22 and rotates the locking member 20 in direction E1. Then, the protrusion 21 comes out of the first engagement groove 88, and each of the rotating plates 53 is released from locking and can be freely rotated. Hence, when the cam portion 97 continues to be rotated in direction C2 to push the shaft 84, each of the rotating plates 53 is rotated in direction C2 as shown in FIG. 6E, instead of the TPH 51 being rotated in direction D1 to be separated from the platen roller 52. Because the cam portion 97 still pushes the shaft 84 while each of the rotating plates 53 is being rotated in direction C2, the TPH 51 may be slightly moved from the platen roller 52. When contact between the cam portion 97 and the interfering portion 22 ends, the locking member 20 continuously contacts the outer circumference 87 of each of the rotating plates 53 due to an elastic force of the second elastic member 25.

Figure 6F:
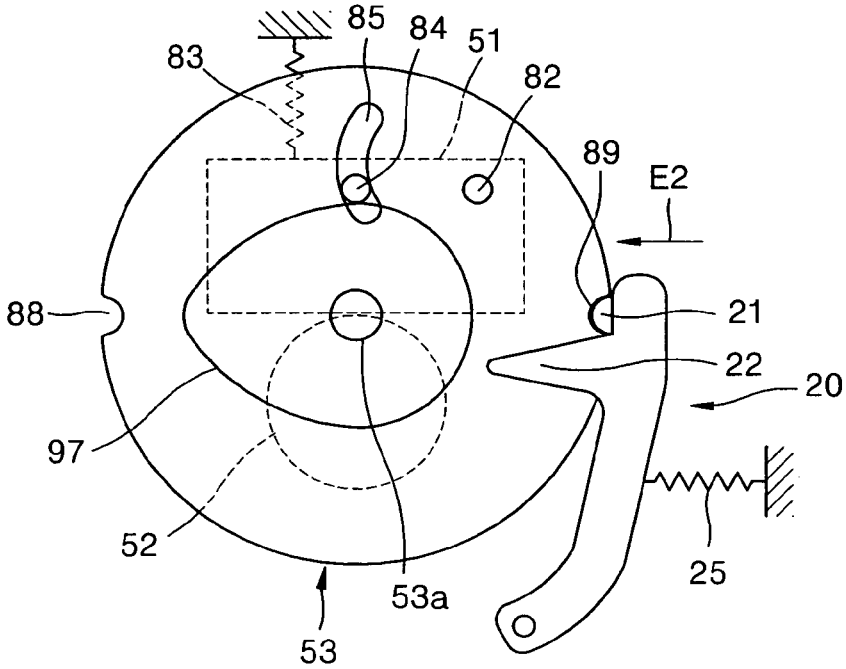

As shown in FIG. 6F, when each of the rotating plates 53 rotates 180 degrees, the locking member 20 is rotated in direction E2 by an elastic force of the second elastic member 25, such that the protrusion 21 is inserted into the second engagement groove 89 and each of the rotating plates 53 is locked and can not be rotated further as the TPH 51 reaches the second position.

Figure 6G:
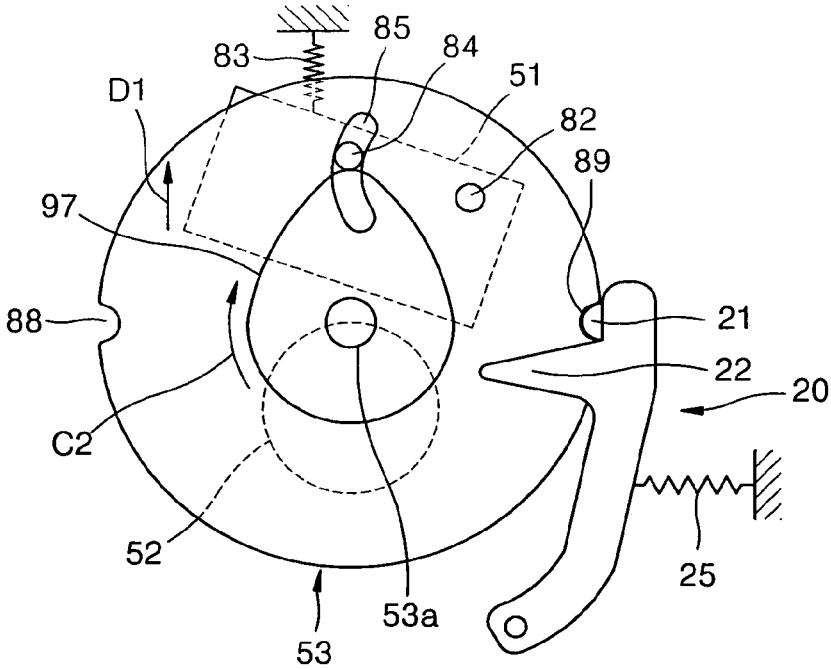

When the rotating cam 95 continues to be rotated in direction C2, each of the rotating plates 53 is not rotated because the protrusion 21 is engaged with the second engagement groove 89. Instead, as shown in FIG. 6G, the shaft 84 is pushed along the through hole 85, so that the TPH 51 is moved from the platen roller 52. Then, as shown in FIG. 7E, a preparation for returning the medium 10 back to the second path is completed.

Figure 6H:
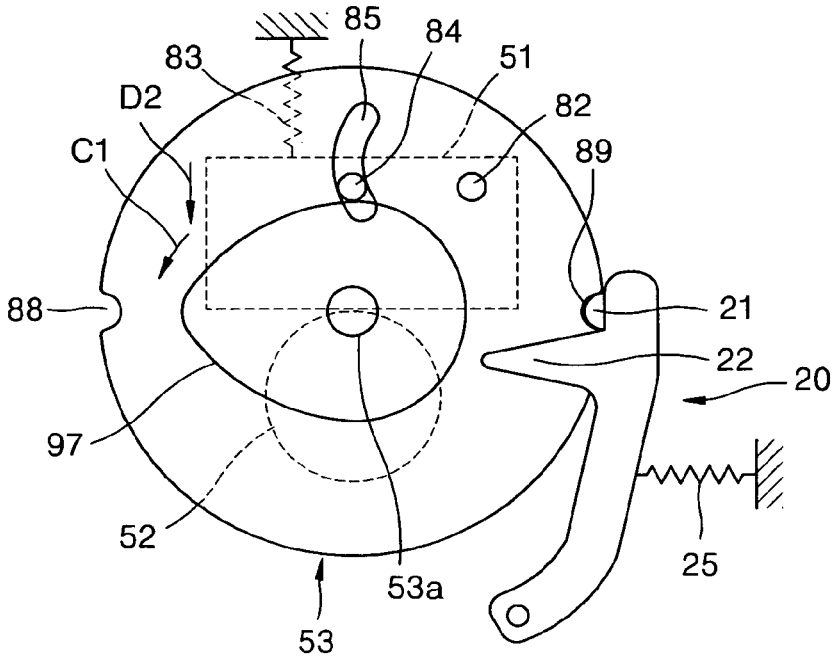
Figure 7F:
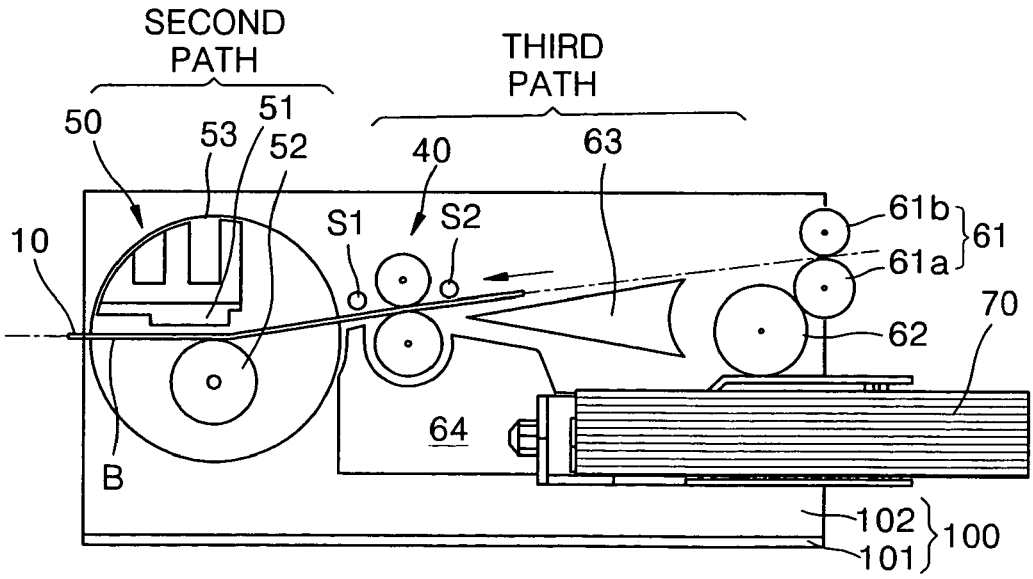
Figure 7G:
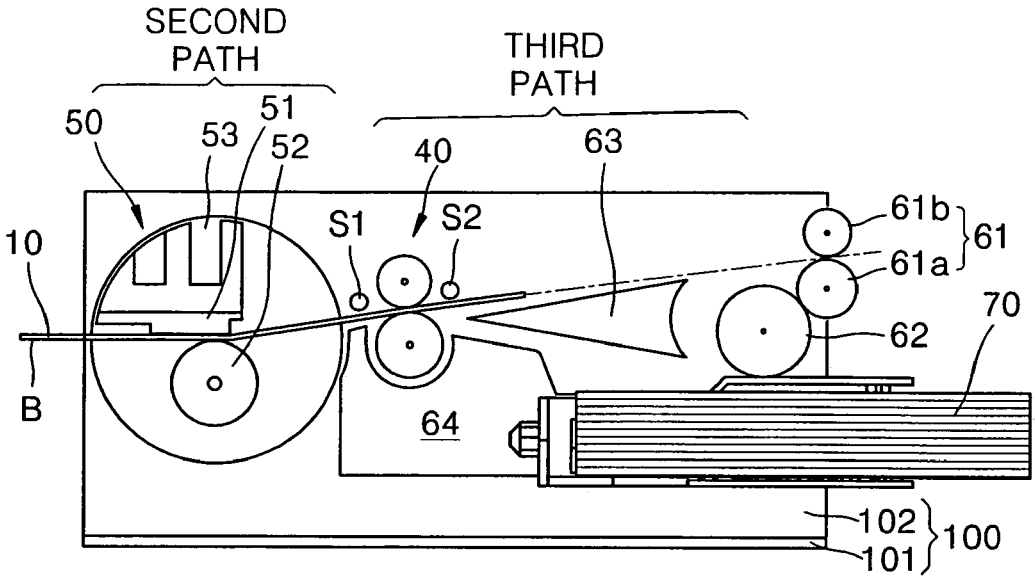

As shown in FIG. 7F, the transfer unit 40 transfers the medium 10 from the third path to the second path. When the medium 10 reaches the printing start location, the transfer unit 40 stops transferring the medium 10. When the rotating cam 95 is rotated in direction C1, each of the rotating plates 53 is not rotated because the protrusion 21 is engaged with the second engagement groove 89. Instead, as shown in FIG. 6H, the TPH 51 is moved toward the platen roller 52 due to an elastic force of the first elastic member 83. Then, as shown in FIG. 7G, the second surface B of the medium 10 faces the TPH 51 and is elastically supported by the platen roller 52.

Figure 7H:
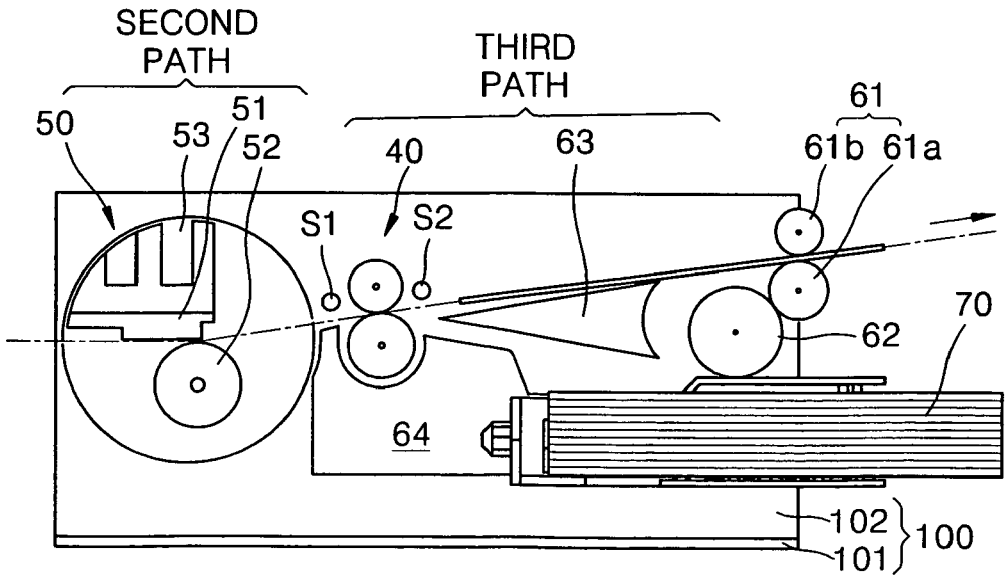

The transfer unit 40 transfers the medium 10 back toward the third path. The TPH 51 heats the second surface B of the medium 10 to print an image of a C color on the second surface B. As shown in FIG. 7H, the medium 10, having first and second surfaces A and B on which images have been printed, is then discharged from the image forming apparatus by the discharge unit 61.

Figure 6I:
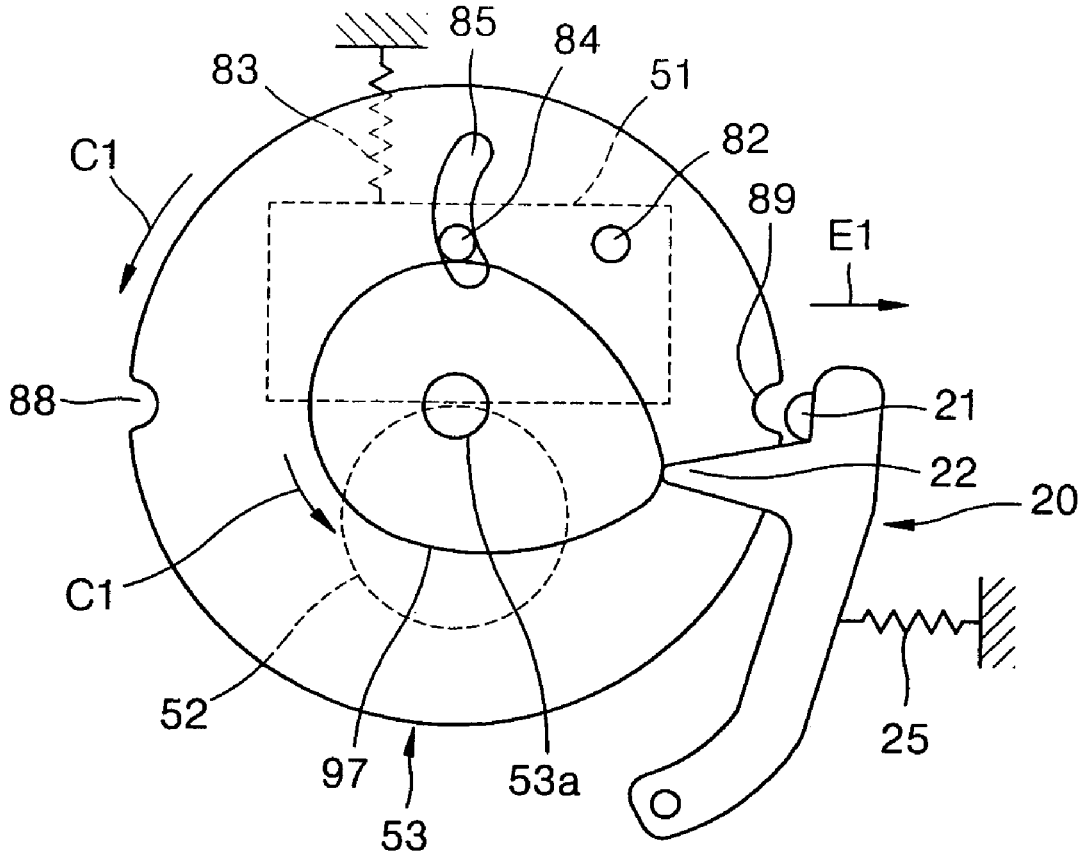
Figure 7I:
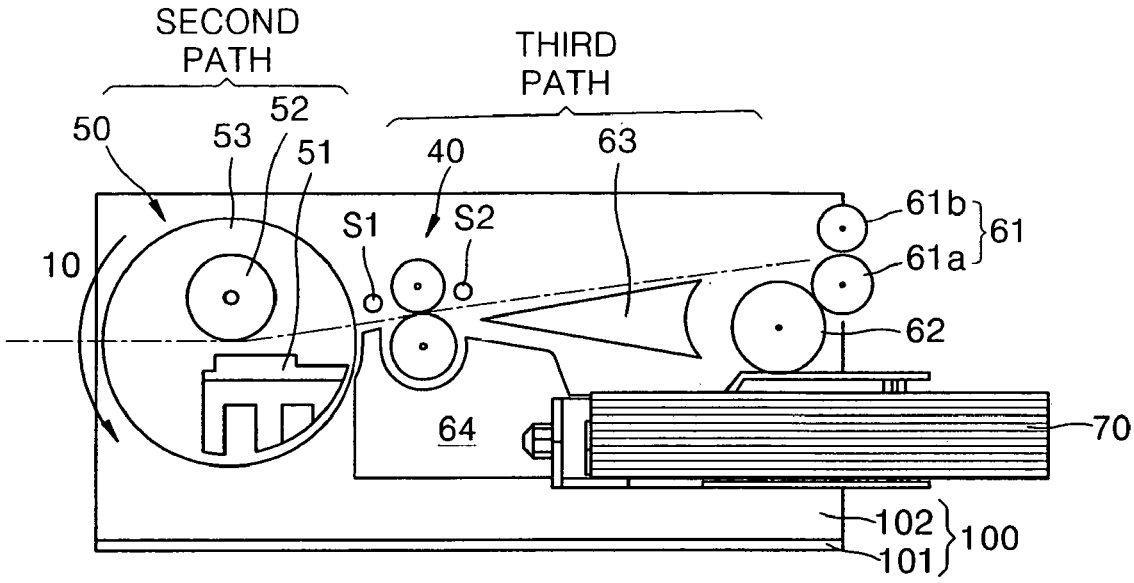

As shown in FIG. 6I, when image printing is completed, the rotating cam 95 is rotated in direction C1. The cam portion 97 pushes the interfering portion 22 to rotate the locking member 20 in direction E1. Then, the protrusion 21 is disengaged from the second engagement groove 89, such that each of the rotating plates 53 can be freely rotated. When the cam portion 97 pushes the shaft 84, each of the rotating plates 53 is rotated until the protrusion 21 is engaged with the first engagement groove 88 by an elastic force of the second elastic member 25. Then, as shown in FIG. 6A, the TPH 51 returns back to the first position. The apparatus can await a next printing in either in this state, or when the TPH 51 is separated from the platen roller 52 as shown in FIGS. 6B and 7I.

The base sheet 11 of the medium 10 can be transparent. An opaque film may be formed on a surface of either of ink layers 12 and 13, for example, the ink layer 12. Therefore, when viewed from the ink layer 13 of the medium 10, C, M, and Y color images are overlapped to form a complete color image.

The direct thermal type image forming apparatus of the exemplary embodiments may be used to form different images on the first and second surfaces A and B, that is, to achieve double-sided printing. If the base sheet 11 is opaque, double-side printing can be achieved by forming different images on the first and second surfaces A and B of the medium 10.

According to the present invention as described above, a desired color image can be formed by simply transferring the medium 10 once in a reverse direction along a rectilinear path, and changing a location of the TPH 51 once. In other words, a color image is formed on both surfaces of a medium by returning the medium once along a single path instead of the multiple passes used in a conventional image forming apparatus, so that an image formation period of time, that is, a print period of time, is extremely shortened.

In contrast with a conventional thermal transfer printer using a media and a separate sublimation-type ink ribbon, an image forming apparatus according to the present invention uses a media coated with ink to be sublimated. That is, an image formation can be achieved using only a sheet of media without the need to use both a ribbon for supplying ink, and a ribbon cassette for receiving the ribbon, so the entire costs for consumption goods are reduced.

Since the image forming apparatus according to the present invention does not use a ribbon cassette and the like, and transfers a medium along a very simple path, the image forming apparatus has a very simple and small structure. Hence, the image forming apparatus according to the present invention is not easily broken and can be provided at less expense than existing printers.

Although the image forming apparatus according to the present invention can be applied to general-purpose printers, it is very suitable for greatly compact image forming apparatuses, particularly, compact portable printers, because of its simple structure, and is also suitable for photographic printing to provide an image of upgraded quality, particularly, digital image printers corresponding to digital cameras.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus comprising:

a printing unit for forming an image on a medium having first and second surfaces on each of which an image can be printed, comprising a thermal printing head and a platen roller which faces the thermal printing head and which supports the medium therebetween; and a location change unit for locating the printing unit at any of first and second positions facing the first and second surfaces, respectively, of the medium, wherein the location change unit rotates the printing unit about a contact portion between the thermal printing head and the platen roller to locate the thermal printing head at one of the first and second positions.

2. The image forming apparatus of claim 1, further comprising a transfer unit for transferring the medium.

3. The image forming apparatus of claim 2, further comprising:

a first path along which the medium is initially transferred, wherein the transfer unit is disposed between the first path and the printing unit;

a second path where the printing unit is disposed, and along which the medium is printed; and a third path in communication with a point between the first and second paths, and along which the medium on which an image has been completely printed is discharged.

4. The image forming apparatus of claim 3, further comprising a pickup roller for picking up the medium from a feeding cassette and which is disposed on the first path.

5. The image forming apparatus of claim 4, further comprising a discharge unit disposed on the third path for discharging the medium, wherein the discharge unit comprises:

a discharge roller rotating in relation with the pickup roller; and an idle roller dependently rotating in contact with the discharge roller.

6. The image forming apparatus of claim 2, wherein the transfer unit comprises a driving roller and an idle roller engaged with the driving roller.

7. The image forming apparatus of claim 1. wherein the location change unit comprises:

a plurality of rotating plates, which support both ends of each of the thermal printing head and the platen roller and which are installed rotatably about the contact portion between the thermal printing head and the platen roller; and a rotating cam, which rotates the rotating plates so that the thermal printing head can face any of the first and second surfaces of the medium.

8. The image forming apparatus of claim 7, wherein the location change unit further comprises:

a shaft having one end connected to the thermal printing head and the other end inserted into a through hole formed on the rotating plate; and wherein the rotating cam pushes the shaft to rotate the rotating plates.

9. The image forming apparatus of claim 8, further comprising a locking unit for locking the thermal printing head at either the first or second position.

10. The image forming apparatus of claim 9, wherein the locking unit comprises:

first and second engagement grooves formed in the rotating plate and corresponding to the first and second positions of the thermal printing head, respectively;

a locking member engagable with the first or second engagement grooves; and an elastic member for elastically biasing the locking member in a direction to engage the locking member with the first or second engagement grooves, and wherein the rotating cam disengages the locking member from the first or second engagement grooves to rotate each of the rotating plates.

11. The image forming apparatus of claim 10, wherein:

the rotating plate has a substantially circular circumference; the first and second engagement grooves are formed on the circular circumference of the rotating plate;

the locking member continuously contacts the circular circumference of the rotating plate while the rotating cam is rotating the rotating plates; and the locking member is engaged with the first or second engagement grooves by an elastic force of the elastic member when the thermal printing head is located at the first or second positions, respectively.

12. The image forming apparatus of claim 1, further comprising:

an elastic member for elastically biasing the thermal printing head such that the thermal printing head is guided by the rotating plates;

first and second engagement grooves formed in the rotating plate, corresponding to the first and second positions, respectively, of the thermal printing head;

a locking member engagable with the first or second combining grooves; and an elastic member for elastically biasing the locking member in a direction such that the locking member is engagable with the first or second engagement grooves, wherein the thermal printing head is combined with the rotating plates such as to be rotated in a direction that moves the thermal printing head to and from the platen roller.

13. The image forming apparatus of claim 12, further comprising:

the through hole having a shape of a circular arc based on a rotating axis of the thermal printing head; and the locking member to be engaged with the first or second engagement grooves, such that when engaged with the first or second engagement grooves, the rotating cam comes into contact with the shaft such that the thermal printing head is moved to or from the platen roller, and when the locking member is released from the first or second engagement grooves, the rotating cam pushes the shaft to rotate each of the rotating plates.

14. The image forming apparatus of claim 3, further comprising a media guide for guiding the medium supplied along the first path to the second path, and for guiding the printing-completed medium from the second path to the third path.

15. An image forming method comprising:

transferring along a first path a medium having first and second surfaces on each of which an image can be printed to a printing start location along a second path;

forming an image on the first surface using a printing unit while transferring the medium along a third path at a predetermined printing speed;

returning the medium to the printing start location along the second path after the image formation on the first surface is completed; and forming an image on the second surface using the printing unit while re-transferring the medium along the third path at the predetermined printing speed, wherein the formation of the image on the second surface comprises rotating the printing unit so that the printing unit faces the second surface of the medium.

16. The image forming method of claim 15, wherein:

the printing unit comprises a thermal printing head and a platen roller which faces the thermal printing head to support the medium therebetween; and wherein during the transferring of the medium to the printing start location and the returning of the medium to the printing start location, the thermal printing head and the platen roller are separated from each other.

17. The image forming method of claim 15, wherein the printing unit is rotated about the contact portion between the thermal printing head and the platen roller.

18. The image forming method of claim 15, further comprising discharging the medium after the image formation on the second surface of the medium is completed.

19. An image forming apparatus, comprising:

a printing unit for forming an image on a medium having first and second surfaces on each of which an image can be printed;

a location change unit for locating the printing unit at any of first and second positions facing the first and second surfaces, respectively, of the medium;

a transfer unit for transferring the medium;

a first path along which the medium is initially transferred, wherein the transfer unit is disposed between the first path and the printing unit;

a second path where the printing unit is disposed, and along which the medium is printed;

a third path in communication with a point between the first and second paths, and along which the medium on which an image has been completely printed is discharged; and a pickup roller for picking up the medium from a feeding cassette and which is disposed on the first path.

20. The image forming apparatus of claim 19, further comprising a discharge unit disposed on the third path for discharging the medium, wherein the discharge unit comprises:

a discharge roller rotating in relation with the pickup roller; and an idle roller dependently rotating in contact with the discharge roller.

21. An image forming apparatus, comprising:

a printing unit for forming an image on a medium having first and second surfaces on each of which an image can be printed;

a location change unit for locating the printing unit at any of first and second positions facing the first and second surfaces, respectively, of the medium;

a transfer unit for transferring the medium;

a first path along which the medium is initially transferred, wherein the transfer unit is disposed between the first path and the printing unit;

a second path where the printing unit is disposed, and along which the medium is printed;

a third path in communication with a point between the first and second paths, and along which the medium on which an image has been completely printed is discharged; and a media guide for guiding the medium supplied along the first path to the second path, and for guiding the printing-completed medium from the second path to the third path.

22. An image forming method, comprising:

transferring a medium having first and second surfaces on each of which an image can be printed to a printing start location;

forming an image on the first surface using a printing unit while transferring the medium at a predetermined printing speed;

returning the medium to the printing start location after the image formation on the first surface is completed; and forming an image on the second surface using the printing unit while re-transferring the medium at the predetermined printing speed, wherein the formation of the image on the second surface comprises rotating the printing unit so that the printing unit faces the second surface of the medium.

23. The image forming method of claim 22, wherein:

the printing unit comprises a thermal printing head and a platen roller which faces the thermal printing head to support the medium therebetween; and wherein during the transferring of the medium to the printing start location and the returning of the medium to the printing start location, the thermal printing head and the platen roller are separated from each other.

24. The image forming method of claim 22, wherein the printing unit is rotated about the contact portion between the thermal printing head and the platen roller.

* * * * *